US005327941A

United States Patent [19]

Bitsakis et al.

[11] Patent Number: 5,327,941

[45] Date of Patent: Jul. 12, 1994

[54] CASCADE ORIFICIAL RESISTIVE DEVICE

[75] Inventors: Nicholas Bitsakis, Portsmouth; James Cassidy, Wakefield, both of R.I.

[73] Assignee: The United States of America as represented by the Secretary of the Navy, Washington, D.C.

[21] Appl. No.: 899,520

[22] Filed: Jun. 16, 1992

[51] Int. Cl.[5] ..... F15D 1/02

[52] U.S. Cl. ..... 138/42; 138/44; 366/340

[58] Field of Search ..... 138/42, 43, 44; 239/542, 533.1; 137/625.3; 366/340, 336, 337; 403/339, 340; 15/181, 230, 230.16, 230.19

[56] References Cited

U.S. PATENT DOCUMENTS

| | | | |
|---|---|---|---|
| 582,530 | 5/1897 | Hyatt | 403/339 |
| 589,708 | 9/1897 | Flint | 403/340 |
| 1,391,364 | 9/1921 | Bulow | 403/340 |
| 1,427,924 | 9/1922 | Trust et al. | 403/340 |
| 1,915,867 | 6/1933 | Penick | 138/42 |
| 1,947,586 | 2/1934 | Fletcher | 138/42 |
| 2,470,282 | 5/1949 | Baker et al. | 403/340 |
| 2,693,391 | 11/1954 | Manseau | 366/336 |
| 3,298,197 | 1/1967 | Roth | 403/339 |
| 3,682,443 | 8/1972 | Upmeier | 366/336 |
| 3,782,694 | 1/1974 | Shano | 366/340 |
| 3,856,270 | 12/1974 | Hemker | 366/340 |
| 4,226,368 | 10/1980 | Hunter | 138/42 |
| 4,340,311 | 7/1982 | Crandal | 366/336 |
| 4,501,501 | 2/1985 | Edwards | 138/42 |
| 4,715,395 | 12/1987 | Mainelli et al. | 138/42 |
| 4,967,440 | 11/1990 | Belanger | 15/53.4 |
| 5,127,123 | 7/1992 | Belanger | 15/53.4 |

*Primary Examiner*—Harvey C. Hornsby
*Assistant Examiner*—James F. Hook
*Attorney, Agent, or Firm*—Michael J. McGowan; Prithvi C. Lall; Michael F. Oglo

[57] ABSTRACT

A cascade orificial resistive device for throttling fluid flow which minimizes acoustic noise and internal vibrations is described herein. The device has a hollow body defining a fluid passageway, a plurality of perforated plates mounted within the passageway, a fixed end ring adjacent one end of the perforated plates, and a threadable end ring adjacent an opposite end of the perforated plates to place the plates in compression. Each of the perforated plates is a single piece molded plate having an integral outer ring and an integrally formed center keying mechanism as well as a plurality of orifices. The keying mechanism formed on each plate is designed so that adjacent ones of the plates have their orifices misaligned. In this manner, a pressure drop across each plate is created and the fluid flow through the device is throttled. The device of the present invention has utility in a number of onboard marine vessel systems wherein reduced acoustic noise and internal vibrations are particularly desirable.

11 Claims, 2 Drawing Sheets

CASCADE ORIFICIAL RESISTIVE DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to a device for throttling a flow of fluid and more particularly to a single piece plate to be used within said device. The flow throttling device may be used with a variety of onboard marine vessel systems including torpedoes, missiles and countermeasure tube systems.

(2) Description of the Prior Art

A cascade orificial resistive device (CORD) is a device which throttles pressurized water down to an acceptable flow rate. A cord utilizes a series of perforated plates passing the flow through the plate so as to create an incremental pressure drop across each plate. CORDS are currently used in numerous locations onboard marines vessels for the purpose of quieting flow by reducing flow rates.

Currently, all CORDS are similarly designed. FIGS. 1-5 illustrate a typical CORD construction. As shown therein, prior art CORDS have a metallic body 10 with an end ring 12 welded to the body and a metallic plate assembly assembled within the body 10 adjacent the ring 12. The plate assembly consists of a threaded rod 14, a plurality of perforated plates 16 positioned on the rod and separated from each other and from body 10 by spacer rings 18 and intermediate nuts 20 and washers 22. The assembly is clamped within the body 10 by a threaded end ring 24 on the inlet side 26 of the CORD.

The number of internal parts for a typical 30 plate CORD assembly manufactured in this fashion is 152. Each one of these 152 parts is a non-standard part and must be accurately machined. The perforated plates have a designed hole pattern which does not correspond to standard perforated plate. The spacer rings have close tolerance outside diameters and machine grooves on both sides. Even the nuts are individually machined to insure that their faces are parallel to each other and perpendicular to the center line.

Assembly is very critical to the performance of a standard CORD. For proper operation, all adjacent plates must have misaligned orifice holes in them. Currently, that is achieved by utilizing two differently designed plates. The center hole on each of these plates is keyed to the threaded rod. An assembler must alternate plates to maintain hole misalignment. Further difficulties with the standard system is that close tolerance machining is required to insure precise fitment of the various CORD components. When the components are precisely fitted together, resonances can be avoided. One of the difficulties, however, with the prior art systems, are that plates in the bolted assembly are often not tightly connected together. As a result, vibrations tend to occur during the flow. The metal to metal vibration which occurs can excite the wall of the CORD body and create both structureborne and liquidborne noise.

SUMMARY OF THE INVENTION

It is therefore a principal object of the present invention to provide a cascade orificial resistive device which effectively throttles the flow of a fluid while substantially avoiding the creation of undesirable vibrations and noise.

It is a further object of the present invention to provide a cascade orificial resistive device as above having a reduced number of internal parts.

It is yet a further object of the present invention to provide single piece plates for use in the above cascade orificial resistive device.

Further objects of the present invention are that the device be easily assembled and that the cost of fabrication be greatly reduced. These and other objects and advantages will become more apparent from the following description and drawings. The above objects are realized by providing a CORD device for throttling fluid flow having a housing and a plurality of single piece perforated plates within the housing formed from an elastomeric material such as a high durometer urethane plastic. To reduce the number of parts needed to assemble the CORD device, each of the perforated plates has an integrally molded central keying arrangement and an integrally molded spacer ring.

The keying arrangement allows adjacent plates to have misaligned orifices even though the plates are identical in construction.

In a preferred construction, the flow throttling plates are placed between two end rings, one of which is fixed in position. The other end ring is used to compress the plates together so as to minimize acoustic noise and internal vibrations.

Still other features of the present invention will become more apparent from the following description and drawings in which like reference numerals depict like elements.

DESCRIPTION OF THE PREFERRED EMBODIMENT

Figure 8:
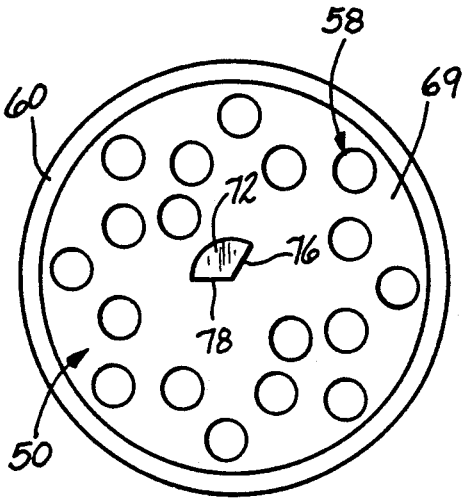
FIG. 8 is a view showing the outlet face of the CORD plate of FIG. 6.
Figure 9:
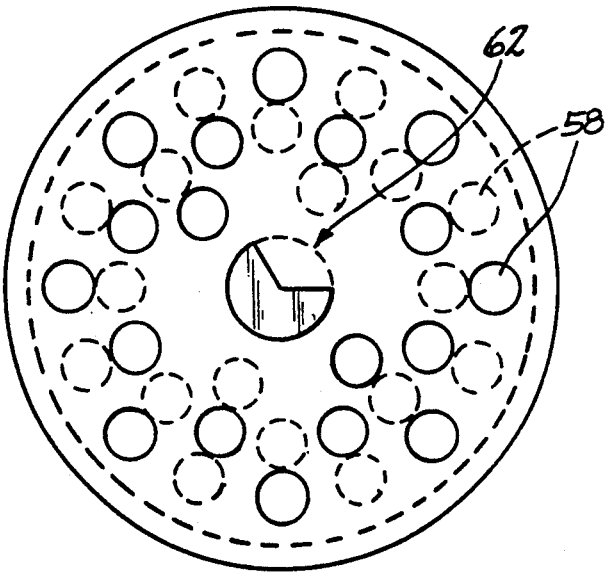
FIG. 9 is a view showing the misaligned orifices in two adjacent molded CORD plates.
Figure 10:
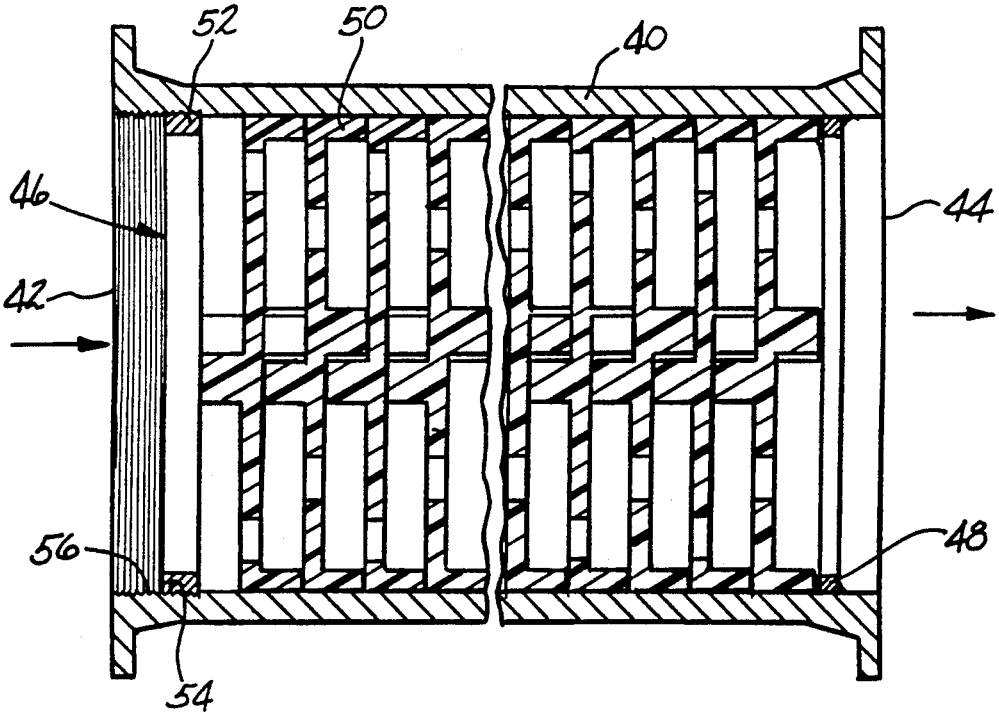
FIG. 10 is a cross-sectional view of a fluid flow throttling device in accordance with the present invention.

Referring now to FIGS. 6-10, there is shown a fluid flow throttling device in accordance with the present invention. As shown in FIG. 10, a cascade orificial resistance device formed in accordance with the present invention includes a metal housing body 40 having a fluid flow inlet 42, a fluid flow discharge outlet 44 and a flow passageway 46 therebetween. An end ring 48 is welded to the metallic housing at a position adjacent the fluid discharge outlet 44. The end ring 48 may be formed from any suitable metallic material. The device further includes a plurality of CORD plates 50 whose construction will be described in detail hereinafter and an end ring 52 for compressing the CORD plates against each other and against the end ring 48. The end ring 52 preferably has a threaded outer ring portion 54 which engages a threaded portion 56 of the housing body 40.

Figure 1:
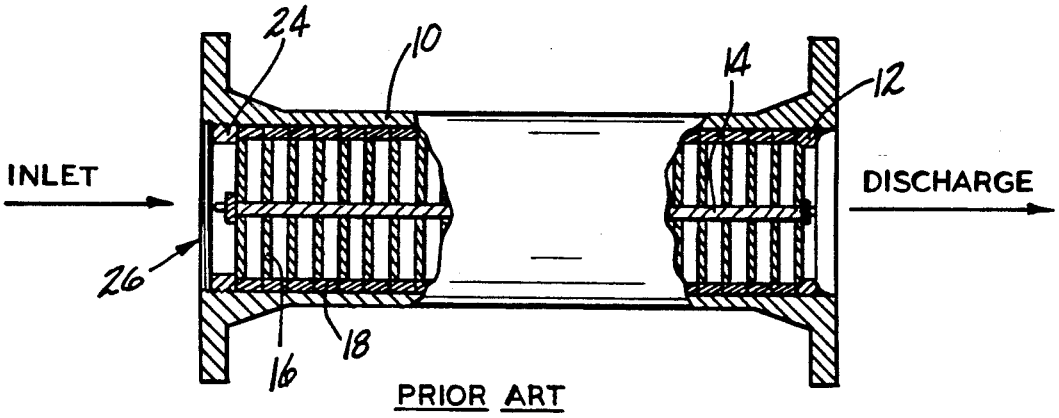
FIG. 1 is a view in partial cross-section of a prior art CORD assembly.
Figure 2:
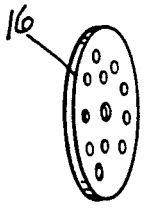
PRIOR ART FIG-2
FIG. 2 illustrates one of the perforated plates used in the CORD assembly of FIG. 1.
Figure 3:
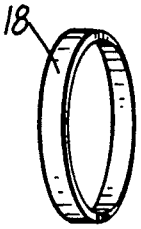
PRIOR ART FIG-3
FIG. 3 illustrates one of the spacing rings used in the CORD assembly of FIG. 1.
Figure 5:
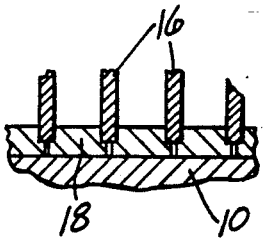
PRIOR ART FIG-5
FIG. 5 illustrates the manner in which the rings and spacers are joined together in the embodiment of FIG. 1.
Figure 4:
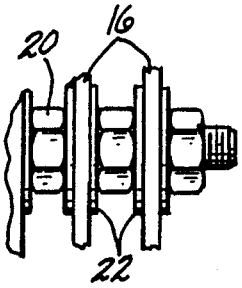
PRIOR ART FIG-4
FIG. 4 illustrates the nuts and bolts used to clamp the plates together in the assembly of FIG. 1.
Figure 6:
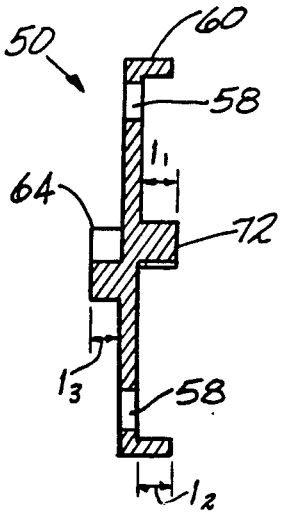
FIG. 6 is a cross-sectional view of a CORD plate formed in accordance with the present invention.
Figure 7:
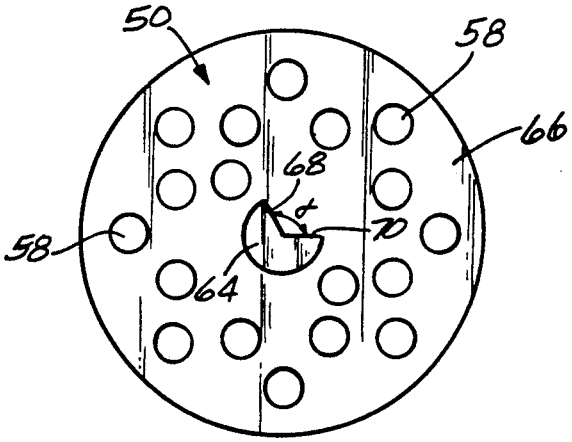
FIG. 7 is a view showing the inlet face of the CORD plate of FIG. 6.

The construction of the CORD plates used in the CORD device of the present invention is shown in the FIGS. 6–8. Each CORD plate 50 is formed from a molded material such as a high durometer elastomeric material. As used herein the term "high-durometer elastomeric material" means a plastic material having sufficient mechanical properties to withstand any foreseeable load on the plates. Useful materials include, but are not limited to, high durometer urethane plastic, nylon and noryl.

Each plate 50 is designed to have a plurality of orifices 58 spaced about the construction. The orifices may have any desired diameter. If desired, orifices having different diameters may be incorporated into a single plate structure. The plate 50 further includes an integrally molded circumferential ring structure 60 and a central keying system 62.

The keying system 62 includes a partially cylindrical key member 64 on an inlet face 66 of the plate. This partially cylindrical keying member has two surfaces 68 and 70 which form an obtuse angle $\alpha$ with respect to each other. The keying system further includes a second key member 72 on the outlet face 69 of the plate 50. The key member 72 is offset from the key member 64. It has, however, a wedge shape which includes two surfaces 25 76 and 78 which form between them an angle which is substantially equivalent to obtuse angle $\alpha$ formed by the surfaces 68 and 70. In a preferred construction, for reasons which will be discussed hereinafter, the key member 72 has a length $l_1$ slightly larger than the extent $l_2$ of the outer ring 60. Typically, the key member 72 will have a length $l_1$ which is approximately 0.010 inches greater than the extent $l_2$ of the outer ring. The length $l_1$ of the key member 62 is preferably equal to the length $l_3$ of the key member 72.

When placed in the fluid passageway 46, the plates 50 are positioned so that the key member 72 on a first plate mates with the key member 64 on an adjacent plate so as to form a substantially cylindrical configuration. By forming the key member 72 so that its surfaces 76 and 78 are at an angle substantially equal to the angle formed by the surfaces 68 and 70 of the key member 64 and offsetting it from the key member 64, one can insure that the orifices of adjacent plates are always misaligned.

It has been found that the construction of the present invention effectively reduces the number of internal parts in a CORD device from approximately 152 to 31 for a 30 plate CORD. This is because elements such as the spacer rings, nuts and washers of the prior art metallic CORDS are no longer required. It has also been found that the construction of the present invention reduced the cost of producing a CORD by an estimated factor of 10 for the internal parts.

Still further, a CORD device formed in accordance with the present invention is quieter than that of the standard design because of the impedance mismatch between the urethane or elastomeric material plates 50 and the metallic body 40. As a result of the design of the present invention, plate vibrations will not tend to excite any other structures. Still another advantage of the present invention is the ease of assembly of the urethane plates and the CORD device.

As previously described, the center keying system of the present invention is designed so that any two adjacent plates 50 will have misaligning orifice holes as shown in FIGS. 9 and 10. An assembler need not alternate between two types of plates in order to achieve proper misalignment. In fact, it is virtually impossible not to achieve the desired effect as a result of the design of this keying system.

As previously described, the key 72 is designed so that adjacent plates 50 will have a small gap, approximately 0.010 inches, between their outer rings 60. As the threaded end ring 52 is tightened, all of the individual plates 50 are deflected until all of the outer rings are in contact with each other. This insures a rigid internal assembly since all of the center keying mechanisms will be in compression as a result of the deflection of the plates. Similarly, all outer rings will be in compression as a result of the threading of the end ring.

The impedance mismatch between the non-metallic plates 50 and the metallic CORD housing body 40 is also advantageous in that structureborne vibrations will not transfer well between the plates and the shell. Ordinarily, CORD plates vibrate while the fluid flow passes through them. The elastomeric CORD plates of the present invention will not transmit energy to the body at the same level as that transmitted by the previously used metallic plates.

Structurally, the high durometer plastic materials contemplated for use in the device of the present invention has more than adequate strength for the job. A CORD is a simple device which operates in a strictly controlled environment. The CORD is always flooded, and the pressure within the line is known. Temperature extremes are not an issue since it is always flooded. Once a downstream valve (not shown) is opened, allowing flow to occur, the pressure drop per plate 50 is on the order of from about 3 to about 5 psi. Simple calculations have shown that stresses caused in the plates due to this pressure are well in the range of plastics.

A typical CORD body formed in conjunction with the present invention may be used in a number of onboard marine vessel applications. For example, they may be used in torpedo, missile and countermeasure tube systems.

A typical CORD device formed in accordance with the present invention may have a 4 inch diameter CORD housing body. Additionally, each plate 50 may use 18 one-half inch diameter orificial holes. Of course, it should be recognized that these dimensions are illustrative and devices having other appropriate dimensions may be used with the same effects.

Still another advantage of the present invention is that the CORD device has no moving plates and no moving parts.

It is apparent that there has been provided in accordance with this invention a cascade orificial resistive device having a plurality of single piece plates which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A device for throttling a fluid flow while minimizing acoustic noise and internal vibrations which comprises:

a hollow body having a fluid inlet, a fluid outlet and a fluid passageway therebetween;

at least two perforated plates mounted in said fluid passageways for throttling a flow of fluid through said passageway;

said at least two plates being arranged so that orifices in a first plate are selectively misaligned with respect to orifices in a second adjacent plate;

each said plate being formed from an elastomeric material;

means for joining said first and second plates together so that said orifices in said first plate are selectively misaligned with respect to said orifices in said second plate;

said joining means comprising an integrally formed, partially cylindrical key member located centrally on one of said plates and a mating wedge shaped key member located centrally on the other of said plates;

said partially cylindrical key member having first and second surfaces defining a first angle therebetween;

said wedge shaped kay member having third and fourth surfaces defining a second angle which is substantially equal to said first angle; and said kay members forming a substantially cylindrical configuration when mated.

2. A device according to claim 1 further comprising:

each said plate having an inlet face and an outlet face; and each said plate having said partially cylindrical key member projecting outwardly from a first one of said faces and said wedge shaped key member projecting outwardly from a second one of said faces.

3. A device according to claim 1 wherein each said plate is a single piece plate having an integrally formed circumferential spacer ring.

4. A device according to claim 3 wherein:

each said plate has an outlet face and one of said key members integrally molded to said outlet faces; and said spacer ring extends parallel to said key member molded to said outlet face and has a length less than that of said key member molded to said outlet face.

5. A device according to claim 1 wherein each said plate is formed from a high durometer elastomeric material.

6. A device according to claim 1 wherein a pressure drop of from about 3 psi to about 5 psi occurs across each of said perforated plates.

7. A device for throttling a fluid flow while minimizing acoustic noise and internal vibrations which comprises:

a hollow body having a fluid inlet, a fluid outlet and a fluid passageway therebetween;

a plurality of perforated plates positioned within said fluid passageway for throttling a flow of fluid through said passageway;

each said plate having a plurality of orifices therein and an integrally molded spacer ring;

means for joining said plates together so that said orifices in any of said plates are misaligned with respect to the orifices in at least one adjacent plate;

said joining means including an integrally formed key member centrally located on a first face of a first one of said plates and an integrally formed mating key member centrally located on a second face of a second one of said plates, said first face facing said second face, and said key members forming a substantially cylindrical configuration when mated;

means for compressing said plate against each other so as to substantially avoid the production of noise and vibrations;

said compressing means comprising a first end ring positioned within said hollow body and welded thereto at a desired location;

said compressing means further comprising a second end ring positioned entirely within said hollow body and threadedly engaging a threaded portion of said hollow body; and said second end ring upon tightening deflecting all of said plates until all of said spacer rings are in contact with each other and said key members are in compression.

8. A single piece plate for use in a device for throttling a flow of fluid, said plate comprising:

a generally circular plate having a plurality of orifices;

an integrally formed key system for positioning said plate relative to an adjacent plate so that said orifices in said plate are misaligned with respect to orifices in said adjacent plate;

said keys system comprising a partially cylindrical key mounted to a first face of said plate and a wedge shaped key mounted to a second face of said system; and said wedge shaped key being offset with respect to the partially cylindrical key.

9. A single piece plate according to claim 8 further comprising:

said plate being formed from a non-metallic, elastomeric material.

10. A single piece plate according to claim 8 further comprising:

said plate being formed from a high durometer urethane material.

11. A single piece plate for use in a device for throttling a flow of fluid, said plate comprising:

a generally circular plate having a plurality of orifices;

an integrally formed key system for positioning said plate relative to an adjacent plate so that said orifices in said plate are misaligned with respect to orifices in said adjacent plate;

said key system comprising a partially cylindrical key mounted to a first face of said plate and a wedge shaped key mounted to a second face of said system;

said wedge shaped key being offset with respect to the partially cylindrical key;

said partially cylindrical key having first and second surfaces defining an obtuse angle; and said wedge shaped key having third and fourth surfaces defining an angle substantially equal to said obtuse angle.

* * * * *